US007021925B2

(12) United States Patent
Perryman

(10) Patent No.: US 7,021,925 B2
(45) Date of Patent: Apr. 4, 2006

(54) SAFETY MODULE FOR FUEL-BURNING APPLIANCE, AND APPLIANCE USING SUCH A MODULE

(75) Inventor: Charles Perryman, Torquay (GB)

(73) Assignee: Invensys Controls Limited, London (GB)

( * ) Notice: Subject to any disclaimer, the term of this patent is extended or adjusted under 35 U.S.C. 154(b) by 59 days.

(21) Appl. No.: 10/157,746

(22) Filed: May 29, 2002

(65) Prior Publication Data

US 2004/0045543 A1 Mar. 11, 2004

(51) Int. Cl.
*F23N 5/24* (2006.01)
*F23N 5/00* (2006.01)

(52) U.S. Cl. ..... 431/22; 431/13; 431/14; 431/15; 431/76; 340/632

(58) Field of Classification Search ..... 431/13, 431/14, 15, 16, 18, 22, 76; 340/632, 634, 340/521, 522
See application file for complete search history.

(56) References Cited

U.S. PATENT DOCUMENTS 4,443,791 A * 4/1984 Risgin et al. ..... 340/634
5,189,392 A * 2/1993 Kass et al. ..... 340/521
5,239,980 A * 8/1993 Hilt et al. ..... 126/116 A
5,379,026 A * 1/1995 Whittle ..... 340/632
5,397,233 A * 3/1995 Eavenson et al. ..... 431/80
5,540,273 A * 7/1996 Polk et al. ..... 165/11.1
5,575,274 A * 11/1996 DePalma ..... 126/512
5,797,358 A * 8/1998 Brandt et al. ..... 122/448.1
6,145,502 A * 11/2000 Lyons et al. ..... 126/512

FOREIGN PATENT DOCUMENTS

EP 000498034 A2 * 12/1992
EP 000814444 A2 * 12/1997
JP 57-10023 * 1/1982
JP 61-231343 * 10/1986
JP 62-266320 * 11/1987
JP 06-137555 * 10/1992
JP 2001-14573 * 9/1994
JP 08-86437 * 4/1996
JP 10-38270 * 7/1996
JP 09-112980 * 5/1997
JP 11-51383 * 2/1999
JP 2001-14573 * 1/2001
JP 2001-193928 * 7/2001
JP 2001-296020 * 10/2001
WO WO 97/42451 * 12/1997

OTHER PUBLICATIONS

Japanese 11-051383 Abstract and Japanese Patent Office computer translation*

* cited by examiner

*Primary Examiner*—Carl D. Price

(57) ABSTRACT

The invention provides a safety module for connection to a fuel-burning appliance. The safety module connects to the existing circuitry of the appliance and triggers an alarm response when certain predetermined conditions are met. The safety module includes a CO sensor and a processor and can respond not only to acutely high CO levels but also to chronically high CO levels and lack of adherence to service schedules amongst other conditions. The safety module can also be programmed/reset.

12 Claims, 1 Drawing Sheet

SAFETY MODULE FOR FUEL-BURNING APPLIANCE, AND APPLIANCE USING SUCH A MODULE

FIELD OF THE INVENTION

The invention relates to a safety module for a fuel-burning appliance, and to an appliance using such a safety module. In particular, the invention relates to a safety module which provides an alarm response (such as shutting off the fuel supply or sounding an alarm) when predetermined conditions are reached.

BACKGROUND OF THE INVENTION

Fuel-burning appliances are of many types. Fuels used include gas, kerosene, solid fuel and many others. Fuel-burning appliances are commonly used for e.g. heating in both domestic and commercial applications. A well-known and dangerous by-product of such appliances, however, is carbon monoxide. Carbon monoxide is an odorless, tasteless, poisonous gas, which cannot readily be detected. In conjunction with fuel-burning appliances, therefore, some form of CO detector is frequently supplied, either as a separate detector or as an integral part, of the appliance.

One type of device used to sense the presence of CO is an Oxygen Depletion Sensor (ODS), which responds to a drop in the oxygen concentration of the surrounding air. ODS sensors commonly produce an alarm response when the oxygen level drops to, say, 95% of the normal level. A typical alarm response might be, for example, the cutting off of the fuel supply and/or the sounding of an alarm signal. It is well known, however, that concentrations of CO which are not low enough to trigger an ODS may still be high enough to cause ill effects, particularly over a long period. It has therefore been suggested to use a detector which reacts to the presence of carbon monoxide (as opposed to the absence of oxygen), either instead of or as well as an ODS.

The provision of both a carbon monoxide sensor and an ODS in a fuel-burning appliance has hitherto required the provision of two separate circuits in the appliance, bringing with it increased complexity and costs. The absence of both types of sensor, however, can lead to ill health and possibly fatal effects.

SUMMARY OF THE INVENTION

It is an object of the present invention to provide a safety module for a fuel-burning appliance which avoids the above problems. In particular, it is an object of the present invention to provide a safety module for a fuel-burning appliance which is simple, economical, easily maintained & replaced and which provides early detection of high levels of carbon monoxide. It is a further object of the invention to provide a safety module which responds not only to acutely high levels of CO but also to chronically high levels of CO and provides a means to ensure adherence to servicing requirements etc. It is a yet further object of the present invention to provide such a safety module which responds to certain predetermined conditions, the said predetermined conditions being easily programmable and alterable. It is a still further object of the present invention to provide a fuel-burning appliance using such a safety module.

In accordance with the above objects the invention provides a safety module for a fuel-burning appliance, the said safety module being adapted and arranged for connection to a fuel-burning appliance so that an alarm response of the fuel-burning appliance is triggered by an alarm signal of the said safety module, the safety module comprising processing means adapted so as to initiate a said safety module alarm signal when one or more predetermined conditions have been reached.

Preferably the said processing means includes a suitably programmed integrated circuit chip. Advantageously, programming means are provided whereby programming of the said processing means may be effected.

Preferably the said safety module includes a carbon monoxide sensor connected to the said processing means. Particularly preferably, the said safety module is adapted to be connected to the existing alarm circuitry of a fuel-burning appliance. Advantageously, the said existing alarm circuitry includes an oxygen depletion sensor.

Advantageously, the said predetermined conditions include one or more of the following; the detection of a CO level by the said CO sensor over a predetermined first threshold value at any one time; the detection of a CO level by the said CO sensor over a predetermined second threshold value over a predetermined time period; a predetermined time interval having elapsed and/or, where the said safety module is provided with reset means, the safety module having been reset a predetermined number of times. Particularly preferably, the programming means may be used to program the processing means with a value for one or more of the said first threshold value, second threshold value, predetermined time interval and/or predetermined number of times. Preferably, means are provided to provide a permanent alarm signal when any or all of the said predetermined conditions have been met.

According to a preferred realization of the invention the components thereof are provided on a printed circuit board so as to provide an integrated safety module.

According to another aspect, the invention provides a fuel-burning appliance having a safety module as described above.

BRIEF DESCRIPTION OF THE DRAWINGS

For a better understanding of the present invention and to show more clearly how it may be carried into effect, reference will now be made, by way of example, to the accompanying drawings which show schematically various embodiments of the present invention. The figures are not to scale.

DETAILED DESCRIPTION OF THE INVENTION

Figure 1:
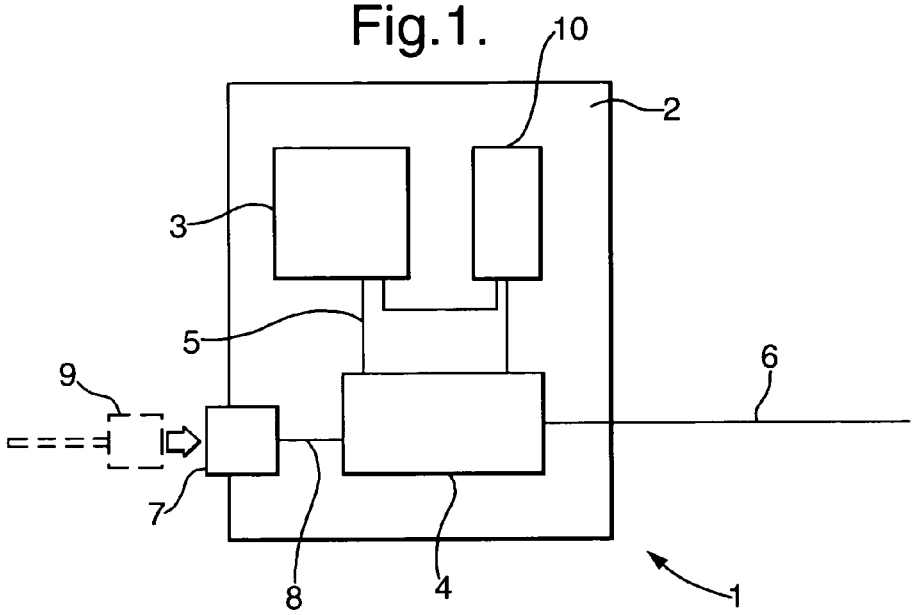
FIG. 1 shows a safety module according to one embodiment of the present invention.

FIG. 1 shows a safety module (1) which compilses a printed circuit board (2) upon which is mounted a carbon monoxide sensor (3) such as a Monox Compact sensor manufactured by Monox Ltd., UK. An integrated Circuit (IC) chip (4) is also provided on the circuit board. The IC (4) has a two-way connection (5) to the sensor (3). The IC (4) also has an alarm line (6) for outputting an alarm signal. A socket (7) is also connected to the IC (4) by means of a second two-way connection (8). During assembly and commissioning/servicing of the safety module (1), the plug (9) of a control device (not shown) can be inserted into the socket (7) so that signals can be input to/read from the IC (4). The module (1) can thereby be calibrated/reset. This plug-and-socket arrangement provides readily accessible means to perform sophisticated programming/resetting functions. The IC (4) has been pre-programmed with software which uses signals from the CO sensor (3) to calculate and monitor the ambient carbon monoxide level and provide an appropriate signal on the alarm line (6) depending on the detected conditions, A power supply (10), typically a dry cell battery, provides power for the module. The IC (4) has an integral clock, which Is used to help determine the maintenance requirements and servicing frequency.

Figure 2:
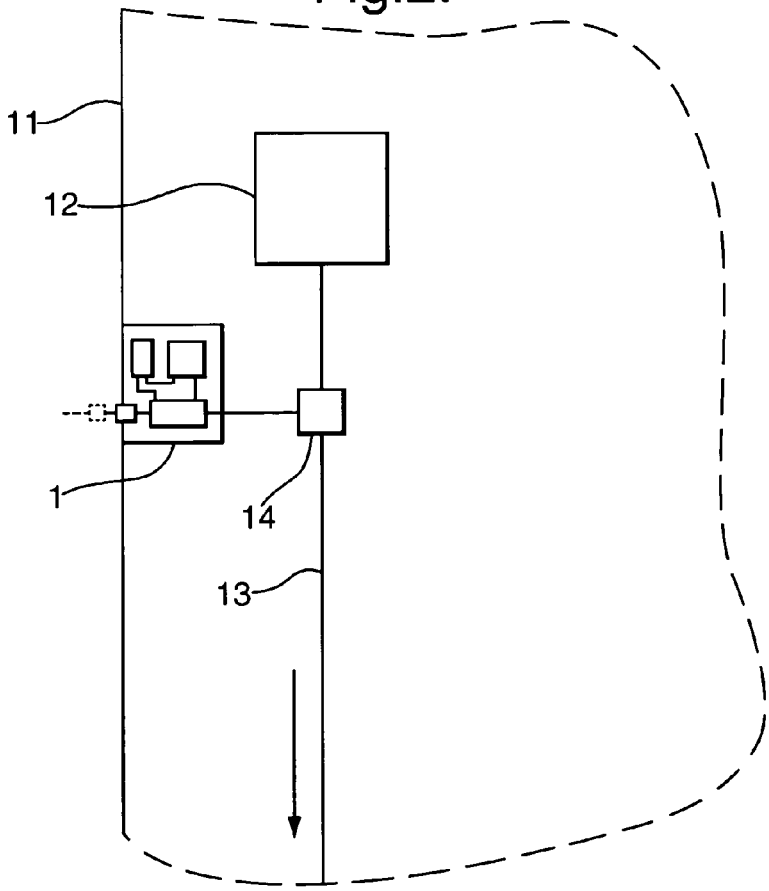
FIG. 2 shows the module of FIG. 1 installed in an appliance.

In FIG. 2 a gas appliance (shown partially as 11) has a safety module (1) installed. The gas appliance is provided with an oxygen depletion sensor (12) which has an ODS alarm line (13). The ODS alarm line (13) is used to trigger an alarm response of the gas appliance when low oxygen levels are detected. A particular signal appearing on the alarm line (13) may, for example, trigger the sounding of an audible alarm and/or cut off the gas supply to the appliance. The safety module (1) is adapted and arranged for connection to the ODS alarm line (13) by means of a connector (14) in such a way that a suitable alarm signal output by either the ODS (12) or the safety module (1) will trigger the alarm response. In this way, a separate wiring system is not required for the safety module (1) of the invention. The carbon monoxide level at which the safety module (1) can provide a warning is several orders of magnitude below required to trigger the ODS (12) on its own.

The integral safety module (1) is preferably self-contained. The battery (10) and sensor (3) are replaceable. The module is connected to the alarm line (13) of an existing ODS (12) to fulfill its intended role. The module (1) is designed to be securely and permanently attached to e.g. the base of a fuel-burning appliance such as a gas-fired heater. The CO sensor (3) may be positioned so as to monitor the air in the environment of the gas appliance, or may be positioned so as to monitor air in a particular area of the appliance such as an inlet duct or outlet duct.

The software installed on the IC (4) can be configured to activate an alarm signal at varying (predetermined) levels of CO. These can be a single set point or averaged over time, or set so as to comply with any existing standard such as any statutory British, European, or North American residential carbon monoxide detector standard as appropriate. Alternatively, the safety module could be programmed so as to comply with commercial or industrial boiler applications and their requisite standards using an appropriate relay.

Preferably, the IC (4) is programmed so as to interrupt the operation of the appliance (11) if it has not been serviced (and the module reset) after a certain time, say 13 months. This feature has been designed to assist landlords trying to fulfill their obligations under statutory regulations requiring regular inspections. This obligation is often difficult to meet as tenants are not always keen on allowing authorized staff entry to perform the inspections. The IC can therefore be programmed to trigger an alarm situation (e.g. a fuel cut-off) every 20 minutes or so causing the occupant to have to re-light the appliance every 20 minutes or get it properly serviced. This will encourage regular servicing. During the service the module can then be reset the to provide a further 13 months of operation. Alternatively, or additionally, the IC (4) can be programmed so that a specific number (e.g. five) operations of the reset function will require the installation of a new sensor in line with e.g. warranty requirements. Tamper-evident systems may also be provided.

The invention therefore provides an integrated safety module for connection to a fuelburning appliance. The safety module connects to the existing circuitry of the appliance and triggers an alarm response when certain predetermined conditions are met. The safety module includes a CO sensor and processing means and can respond not only to acutely high CO levels but also to chronically high CO levels and can also respond to pre-set service schedules amongst other conditions. Means are provided whereby the safety module can be programmed/reset.

While various descriptions of the present invention are described above, it should be understood that the various features could be used singly or in any combination thereof. Therefore, this invention is not to be limited to only the specifically preferred embodiments depicted herein.

Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. An alarm system for use with a fuel-burning appliance, the alarm system comprising:

an alarm circuit operable to generate an alarm signal along an alarm line to initiate an alarm response when a first condition is met;

a safety module connected to the alarm line and operable to generate a safety module alarm signal along the alarm line when a second condition is met, wherein the alarm response is initiated upon generation of either the safety module alarm signal or the alarm signal along the alarm line, wherein the safety module comprises a carbon monoxide sensor operable to detect a level of carbon monoxide and a processing means connected to the carbon monoxide sensor and operable to generate the safety module alarm signal when the second condition is met, wherein the safety module can be reset and wherein the processing means monitors the duration of operation of the safety module from the most recent reset and initiates the safety module alarm signal after a predetermined time interval has elapsed from the most recent reset.

2. The alarm system according to claim 1 wherein the processing means includes a suitably programmed integrated circuit chip.

3. The alarm system according to claim 1 further comprising programming means for programming of the processing means.

4. The alarm system according to claim 1 wherein the alarm circuit includes an oxygen depletion sensor.

5. The alarm system according to claim 1 wherein the second conditions includes at least one of the following: the detection of a CO level by the carbon monoxide sensor over a predetermined first threshold value at any one time; and the detection of a CO level by the carbon monoxide sensor over a predetermined second threshold value over a predetermined time period.

6. The alarm system according to claim 5 wherein means are provided to provide a permanent alarm signal when any or all of the second conditions have been met.

7. The alarm system according to claim 6 wherein the programming means may be used to program the processing means with a value for at least one of the first threshold value, second threshold value, and predetermined time interval.

8. The alarm system according to claim 1 in which the alarm response is to interrupt operation of the fuel burning apparatus.

9. The alarm system according to claim 1 in which the alarm response is a periodic fuel cut-off.

10. The alarm system of claim 1 wherein the second condition is met upon detection of a carbon monoxide level above a predetermined first threshold value at any given time or upon detection of a carbon monoxide level over a predetermined second threshold value for more than a predetermined time period.

11. The alarm system of claim 10 wherein the first threshold value is greater than the second threshold value.

12. The alarm system of claim 1 wherein the safety module monitors the number of times the safety module is reset and initiates the safety module alarm signal after the safety module has been reset a predetermined number of times.

* * * * *